United States Patent [19]

Moore

[11] Patent Number: 4,588,248

[45] Date of Patent: May 13, 1986

[54] SOCKET

[75] Inventor: Marvin W. Moore, Oxford, Mich.

[73] Assignee: Microdot Inc., Darien, Conn.

[21] Appl. No.: 696,504

[22] Filed: Jan. 30, 1985

[51] Int. Cl.[4] ..... H01R 4/00

[52] U.S. Cl. ..... 339/94 L; 339/125 L; 339/119 L; 339/258 R

[58] Field of Search ..... 339/94, 126 R, 126 RS, 339/103 B, 59 R, 59 M, 59 L, 91 L, 61 L, 206 R, 176 L, 182 L, 191 L

[56] References Cited

U.S. PATENT DOCUMENTS

| | | | |
|---|---|---|---|
| 2,219,940 | 10/1940 | Ritz-Woller | 339/103 B |
| 3,371,306 | 2/1968 | Moranduzzo | 339/59 L |
| 3,495,028 | 2/1970 | Tutthill | 339/94 A |
| 3,649,955 | 3/1972 | Schmidt et al. | 339/94 A |
| 3,753,214 | 8/1973 | DuRocher et al. | 339/206 R |
| 3,993,388 | 11/1976 | Konzorr | 339/59 L |
| 3,999,095 | 12/1976 | Pearce et al. | 339/91 L |
| 4,386,817 | 6/1983 | Benker et al. | 339/103 B |

FOREIGN PATENT DOCUMENTS

| | | | |
|---|---|---|---|
| 963967 | 3/1975 | Canada | 339/94 L |

*Primary Examiner*—Gil Weidenfeld
*Assistant Examiner*—David L. Pirlot
*Attorney, Agent, or Firm*—Lyman R. Lyon

[57] ABSTRACT

A socket for the reception of a bulb comprising a housing having an elongated cylindrical aperture for the acceptance of a multipurpose resilient grommet in sealing relationship, an electrically conductive wire extending through the central bore of said grommet, and an internal terminal strip that effects wiping of the conductive wire upon insertion and removal of a bulb.

1 Claim, 6 Drawing Figures

SOCKET

BACKGROUND OF THE INVENTION

The present invention relates to a sealed low profile socket for the reception of a bulb. The socket is used in an automotive brake light, tail light, parking light and turn signal systems, or the like. In addition, the improved socket has numerous uses and applications outside of the automobile industry.

Sockets used in automobiles and other vehicles generally comprise a housing adapted to be securely fastened in a complementary aperture in a fixture. A bulb is releasably secured in the housing. At least one wire of a wiring harness of the vehicle is connected to a terminal of the housing internally thereof. The housing has one or more relatively movable terminals internally thereof for engagement with the contacts on the end of the light bulb. Springs are often provided to achieve the requisite "lost motion" to maintain contact pressure between the terminals of the housing and the light bulb.

One problem with known sockets is that moisture and other foreign materials are able to enter the housing of the socket ultimately causing corrosion and failure of electrical contact between the bulb and the internal terminals of the socket. Attempts to solve this problem have generally required permanent sealing of the wire leading into the socket housing by epoxy or the like. While such practices insure positive sealing, service of the socket is rendered impossible and, upon failure thereof due to other circumstances, the entire socket must be replaced. Attempts to sealably yet removably attach the wires to the socket housing have heretofore failed.

The present invention solves the aforementioned problem by utilizing a unique grommet that functions to both seal the wires leading into the socket housing, releasably support a wire contact within the housing that is engageable with an internal terminal of the socket, and provide a resilient lost motion connection between the wire contact and an internal terminal of the socket. Electrical contact betweend the wire contact and the internal terminal is "wiped" upon insertion of the wire contact thereby assuring positive electrical contact.

DETAILED DESCRIPTION OF THE PREFERRED EMBODIMENT OF THE INVENTION

Figure 1:
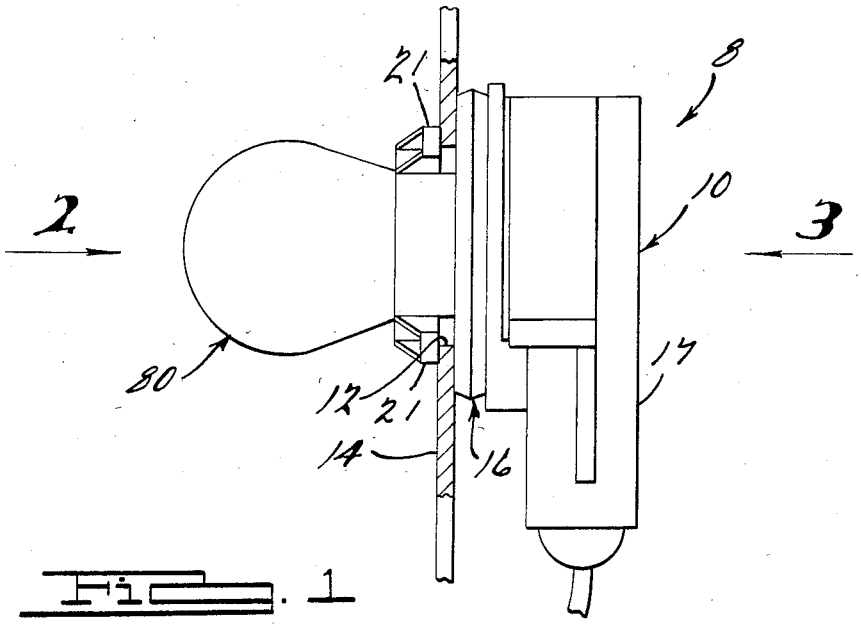
FIG. 1 is a side elevation of an improved socket in accordance with the present invention, shown mounted in a complementary aperture in a light fixture.
Figure 2:
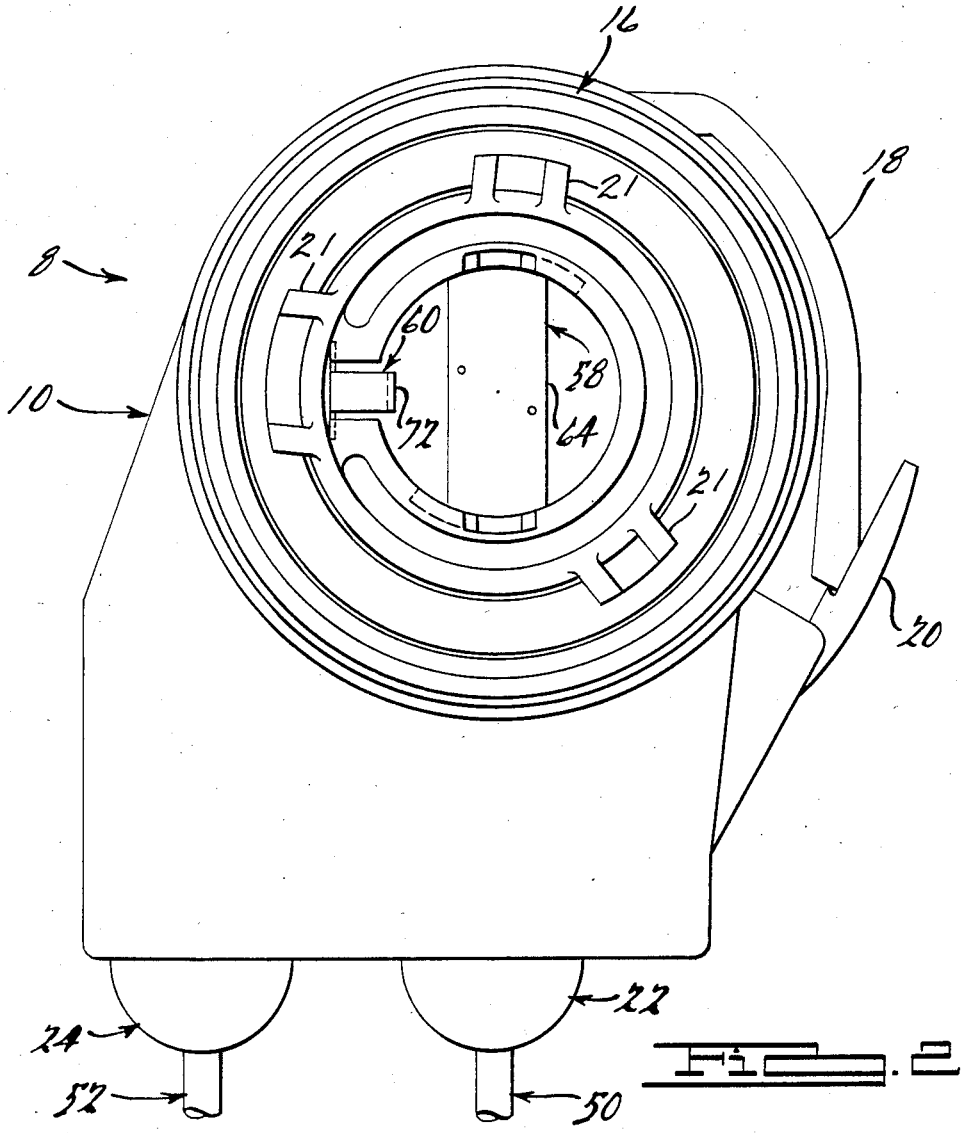
FIG. 2 is a view taken in the direction of the arrow 2 of FIG. 1 with the socket removed from the fixture and the bulb removed.

As seen in FIG. 1 of the drawings, a sealed low profile socket 8, in accordanc with a constructed embodiment of the present invention, comprises a housing 10 adapted to be mounted in a complementary aperture 12 in a fixture or receptacle wall 14. A sealing gasket 16 is disposed between the pheriphery of the aperture 12 in the receptacle 14 and housing 10. A rear wall 17 closes the housing 10 and is sealably bonded thereto.

The housing 10 is provided with an anti-indexing locking arm 18 that projects radially and circumferentially outwardly to engage a complementary shoulder 20 on the receptacle wall 14 thus holding the socket 8 in a locked position within the aperture 12. Conventional locking dogs 21 are provided on a cylindrical portion of the socket which are accepted through complementary apertures in the fixture wall 14 (not shown).

Figure 3:
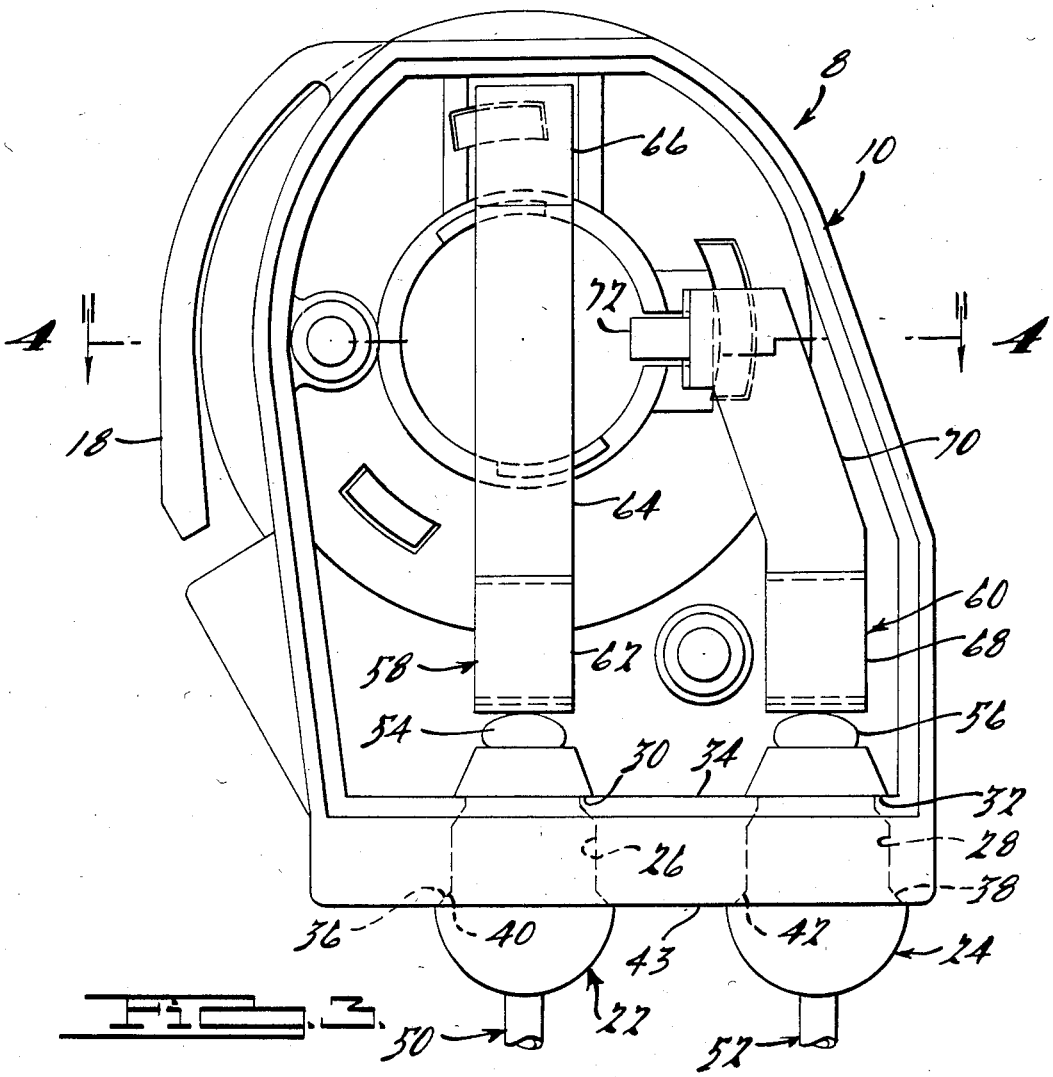
FIG. 3 is a view taken in the direction of the arrow 3 of FIG. 1 with the rear cover of the socket removed.

As best seen in FIG. 3 of the drawings, a pair of rubber grommets 22 and 24 are mounted in complementary holes 26 and 28, respectively, in the housing 10. The grommets 22 and 24 have shoulders 30 and 32 thereon, respectively, that engage an inner surface 34 of the housing 10. In addition, the grommets 22 and 24 have shoulders 36 and 38 which engage complementary shoulders 40 and 42, respectively, adjacent an outer wall 43 of the housing 10. The grommets 22 and 24 are insertable through the holes 26 and 28 by first lubricating the grommets and thereafter forcing them through the holes 26 and 28 whereupon the grommets are streteched so as to bias the shoulders 30, 32, 40 and 42 thereof into tight sealing engagement with their complementary surfaces 34 and 43. Disassembly of the grommets 22 and 24 from the housing 10 can be accomplished by a pull thereon sufficiently strong to pull the shoulder 30 or 32 through its complementary aperture 26 and 28. Normal tension on the grommet will not disengage the grommet from its aperture in the housing 10. Thus, the rubber grommets 22 and 24 are positively locked into the holes 26 and 28 and effect complete sealing of the housing 10 to exclude foreign contaminants therefrom. Also, the inner ends of the grommets 22 and 24 are compressible to augment contact pressure on inner terminals 58 and 68, as will be described.

A pair of wires 50 and 52 extend through the center of the rubber grommets 22 and 24, respectively, in sealed relation thereto. The wires 50 and 52 are capped with button terminals 54 and 56, respectively, that make electrical contact with a pair of terminal strips 58 and 60, respectively, mounted internally of the housing 10.

Figure 4:
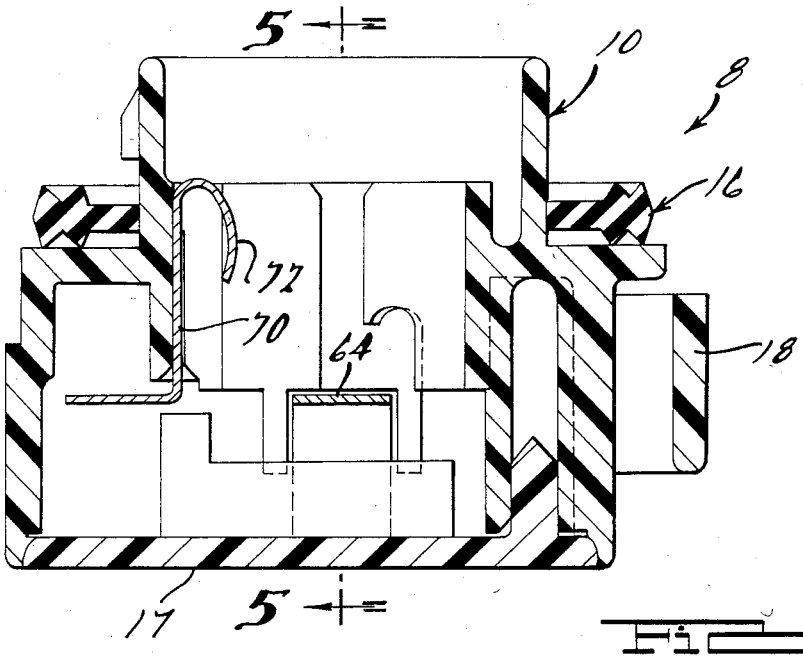
FIG. 4 is a cross sectional view taken generally along the line 4—4 of FIG. 3.
Figure 5:
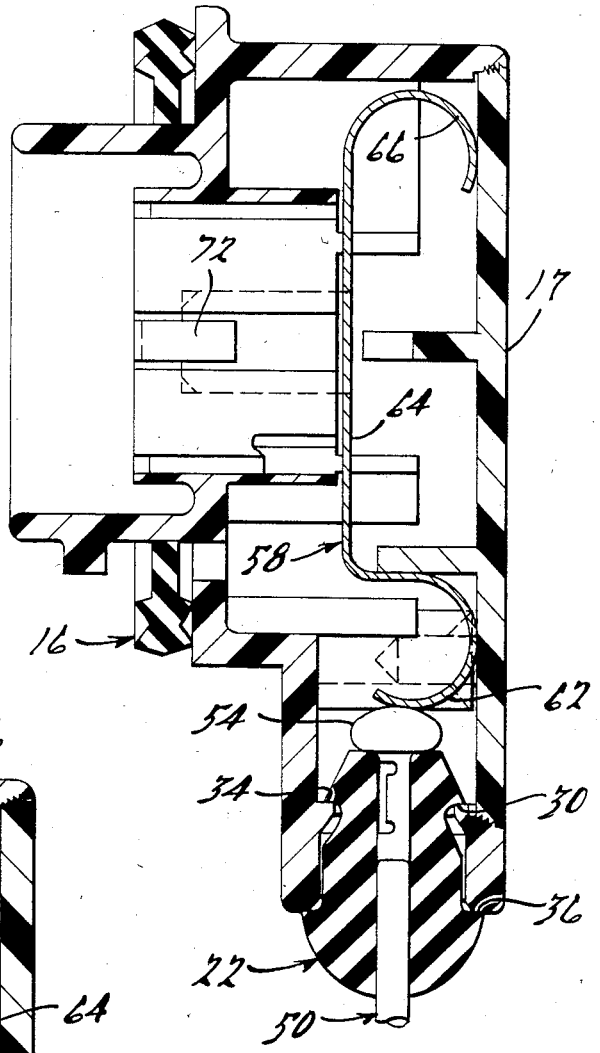
FIG. 5 is a cross-sectional view taken along the line 5—5 of FIG. 4.

As best seen in FIG. 5, the terminal strip 58 comprises an arcuate end portion 62, a flat straight intermediate portion 64 and an arcuate end portion 66. Similarly, the terminal strip 60 has an arcuate end portion 68, a straight intermediate portion 70, and an arcuate bulb contacting end portion 72 (see FIG. 4).

Figure 6:
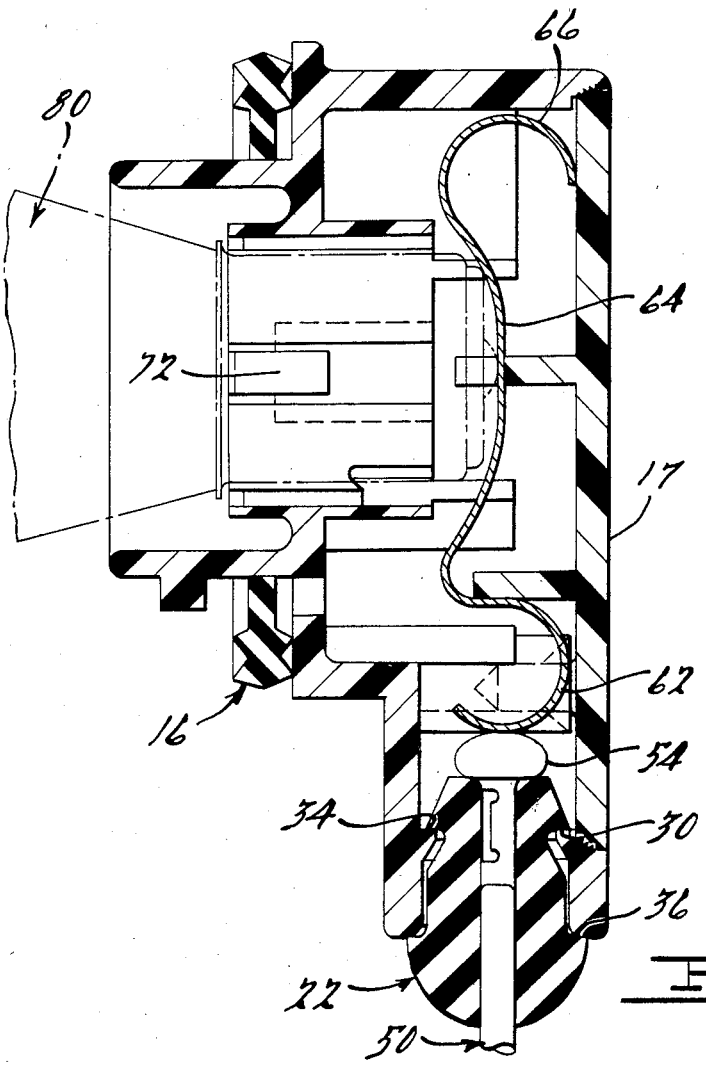
FIG. 6 is a view similar to FIG. 5 with a bulb in operative position.

A comparison of FIGS. 5 and 6 illustrates an important feature of the present invention. The terminal strip 58 has a first orientation relative to the housing 10 when a bulb is not present in the housing 10 as shown in FIG. 5. As seen in FIG. 6, insertion of a bulb 80 into the housing 10 affects deflection of the intermediate portion 64 of the terminal strip 58 so as to exert an outward bias on the bulb to maintain contact pressure thereagainst. It is also to be noted that, upon insertion of the bulb 80, the arcuate lower end portion 62 of the terminal strip 58 rotates slightly in the clockwise direction affecting wiping of the button contact 54 on the end of the wire 50. Removal of the bulb 80 from the socket 10 permits the intermediate portion 64 of the terminal 58 to return to its original configuration shown in FIG. 5 again affecting wiping between the end portion 62 of the terminal strip 58 and the button contact 54. The small but definite wiping movement of the end portion 62 of the terminal strip 58 across the button contact 54 insures positive electrical connection therebetween which is renewed each time a bulb is removed from the housing 10 or replaced therein. A similar wiping action takes place between the end portion 68 of the terminal 60 and its associated button contact 56.

Another feature of the present invention is that depth of the housing 10 is minimized by orientating the flat terminals 58 and 68 so as to lie parallel to the base of the bulb 80.

To assemble the socket 8, the socket housing 10 is first located face down in a holding fixture. Next, the bulb terminals 58 and 60 are laid into the housing 10 in their slot positions. The cover 17 is next placed on top and located with two pins which guide and hold it in position. The whole assembly is then placed under a sonic welder which welds and hermetically seals the cover to the body.

The welded assembly is then removed from its holding fixture and the rubber ring seal 16 is placed over the socket neck and under the twist lock tabs 21. This completes the socket 8.

The housing 10 is a single piece plastic part, is color coded, and determines the socket's focal length. Single or double contact bulbs as well as even or odd "J" slots which retain the bulb 80 and can be accommodated as required by a desired application.

To connect the socket 8 to the wires 50 and 52, the wires are slipped through the rubber grommets 22 and 24, stripped and terminated with the button terminals 54 and 56. This is preferably done when the wire harness is manufactured. The terminated wire and grommet assembly of the wire harness is smooth and soft, with no sharp edges or barbs to damage skin or clothing in handling. It is also resistant to damage from handling.

The wire and grommet assemblies are then inserted into the holes 26 and 28 provided in the socket housing 10. The grommets 22 and 24 should be lightly lubricated for ease of insertion. After insertion, the grommets 22 and 24 position the button terminals 54 and 56 firmly against the terminal strips 58 and 60 and also complete sealing of the socket 8.

Should the wires 50 or 52 be severly pulled or jerked after assembly to the socket 8, the wires 50 and 52 and grommets 22 and 24 will pull out of the socket 8 without damage to the button terminals, the grommets, or the socket, as the grommets are not a positive locking device. The grommets can be reinserted into the socket 8 without replacing or repairing any other part.

From the foregoing description, it should be apparent that the socket of the instant invention is economical, easily assembled, has a flat low profile, and can be positively sealed to withstand the industry standard pressure test of 2 p.s.i. Since the socket is completely sealed and is low and flat, it can be made to fit and lock into any application hole. The connecting wires can be removed from the socket and replaced without breaking the socket or connectors. The wire sealing grommets maintain contact pressure against the socket terminal strips which also effect wiping of the button contacts on the wire upon insertion and removal of a bulb.

While the preferred embodiment of the invention has been disclosed, it should be appreciated that the invention is susceptible of modification without departing from the scope of the following claims.

I claim:

1. A socket for the reception of a bulb comprising a housing, an elongated cylindrical aperture in said housing having laterally extending shoulders at opposite ends thereof, a resilient tensioned grommet in said aperture having a central bore and end portions engageable with said laterally extending shoulders in sealing relationship, an electrically conductive wire extending through the central bore of said grommet, and a terminal strip in said housing having a deflectable flat portion lying in a plane extending at a right angle to a central axis of said bulb and engageable therewith, said terminal having an arcuate end portion engageable with said wire and wipable thereagainst upon insertion and removal of said bulb.

* * * * *